US008139963B2

(12) United States Patent
Takami

(10) Patent No.: US 8,139,963 B2
(45) Date of Patent: Mar. 20, 2012

(54) IMAGE FIXING APPARATUS WITH SAFETY RELAY AND CONTROL THEREOF

(75) Inventor: Hiroshi Takami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 427 days.

(21) Appl. No.: 12/417,279

(22) Filed: Apr. 2, 2009

(65) Prior Publication Data

US 2009/0252521 A1 Oct. 8, 2009

(30) Foreign Application Priority Data

Apr. 7, 2008 (JP) ..... 2008-099508

(51) Int. Cl.
*G03G 15/20* (2006.01)

(52) U.S. Cl. ..... 399/33; 399/67

(58) Field of Classification Search ..... 399/9, 33, 399/38, 44, 67–70; 219/216, 619
See application file for complete search history.

(56) References Cited

U.S. PATENT DOCUMENTS

| | | | | |
|---|---|---|---|---|
| 4,053,733 | A * | 10/1977 | Murata et al. | 219/494 |
| 5,032,874 | A * | 7/1991 | Matsuuchi | 399/33 |
| 5,148,226 | A | 9/1992 | Setoriyama et al. | 355/290 |
| 5,210,579 | A | 5/1993 | Setoriyama et al. | 355/285 |
| 5,386,272 | A * | 1/1995 | Nakazato | 399/33 |
| 5,525,775 | A | 6/1996 | Setoriyama et al. | 219/216 |
| 6,026,257 | A | 2/2000 | Takami et al. | 399/66 |
| 6,421,139 | B1 | 7/2002 | Takami et al. | 358/1.2 |
| 6,744,993 | B2 | 6/2004 | Takami | 399/22 |
| 7,199,335 | B2 | 4/2007 | Takami et al. | 219/497 |
| 7,542,693 | B2 * | 6/2009 | Shin et al. | 399/69 |
| 7,630,662 | B2 * | 12/2009 | Namiki et al. | 399/68 |

FOREIGN PATENT DOCUMENTS

| | | |
|---|---|---|
| JP | 62-49605 | 3/1987 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |

(Continued)

*Primary Examiner* — Hoan Tran
(74) *Attorney, Agent, or Firm* — Fitzpatrick, Cella, Harper & Scinto

(57) ABSTRACT

An image fixing apparatus has an integration circuit which is provided in a signal path from a comparison circuit to a relay drive circuit and integrates a signal input to the integration circuit, wherein an integral value of the signal input to said integration circuit reaches a reference value; and a latch circuit having an input port connected to a signal path from said integration circuit to the relay drive circuit and an output port connected to a signal path from the comparison circuit to the integration circuit. The latch circuit continuously transmits a signal from said output port to the integration circuit, upon a change in a signal level of the input port so that the relay is switched to the open position, and latches the relay in the open position.

4 Claims, 9 Drawing Sheets

FOREIGN PATENT DOCUMENTS

| | | |
|---|---|---|
| JP | 4-204984 | 7/1992 |
| JP | 8-248813 | 9/1996 |
| JP | 2005-141974 | 6/2005 |
| JP | 2005-321573 | 11/2005 |
| JP | 2007-212502 | 8/2007 |

* cited by examiner

IMAGE FIXING APPARATUS WITH SAFETY RELAY AND CONTROL THEREOF

BACKGROUND OF THE INVENTION

1. Field of the Invention

The present invention relates to an image heat-fixing apparatus installed in an image forming apparatus such as a copying machine, a printer, a facsimile, or a multifunction device, thereof using an electrophotographic system (electrophotographic process technology), and particularly to a safety device in the image heat-fixing apparatus.

2. Related Background Art

A well-known image heat-fixing apparatus in an image forming apparatus includes an electric heating element which is a heat source, a temperature detecting unit for detecting a temperature around a heating temperature, and a control unit for controlling electric power to be supplied from a commercial power source to the electric heating element based on a signal from the temperature detecting unit. The image fixing apparatus is of a thermal type for fixing an image by heating a recording medium, on which an unfixed image is formed and carried, in an imaging section of the image forming apparatus. The foregoing arrangement enables an image fixing temperature to be controlled to a predetermined temperature for image fixing. This type of image heat-fixing apparatus does not function as an image fixing apparatus in case of an abnormal function of at least one of the heating element, the power circuit, the temperature detecting unit, and the control unit. Further, an occurrence of current runaway, if any, may lead to breakdown of the apparatus due to overheating.

Therefore, as disclosed in Japanese Patent Application Laid-Open No. 2008-248813, this type of image fixing apparatus includes a temperature detecting unit such as a thermistor located in the vicinity of the heating element to interrupt electricity supply to the heating element, by means of a current-interrupting unit such as a relay interposed in an energized circuit, in cases where the heating element is abnormally heated. The provision of the safety device prevents overheating, smoking, and fire in case of current runaway. The temperature at which the safety device is activated is set to a level higher than a temperature which is reached during normal operation to prevent the safety device from malfunctioning during normal operation so that the safety device operates only in the case of abnormal overheating.

FIG. 10 shows a block circuit diagram of a conventional safety device. A relay 505 is interposed between a commercial power supply and a heating element to interrupt the electricity supply to the heating element during the period in which the relay 505 is off. An operational amplifier 2009 compares an output level of the thermistor with a predetermined reference level. A reference voltage is generated by dividing a supply voltage Vcc between resistors 2010 and 2011. If the temperature of the thermistor is equal to or less than an abnormal overheating temperature, an output of the operational amplifier 2009 is low. This causes a transistor 2006 to be switched off and further a transistor 2003 to be switched on, by which current flows through a coil in the relay 505 and the relay 505 is switched to a closed position (the state which enables electric power to be supplied to the heating element).

In case of occurrence of current runaway in the above condition, a thermistor detection signal decreases and the output of the operational amplifier 2009 is switched from high to low. This causes the transistor 2006 to be switched on and the transistor 2003 to be switched off, by which the current in the coil in the relay 505 stops and the relay is switched to the open position (the state which disables electric power to be supplied to the heating element). In cases where the relay 505 is switched off, a latch circuit 2013 maintains the off state to prevent the relay from being energized again. If a potential of point G in FIG. 10 becomes low, the latch circuit 2013 fixes the potential of the point G to the low level and thereafter the potential of the point G is maintained at the low level independently of the thermistor condition. A time constant circuit is provided inside the latch circuit 2013, so that the latch operation is activated only after the potential of the point G continues to be low for a predetermined period $\tau$. The reason for the provision of the time constant circuit is to prevent the latch circuit from malfunctioning due to noise in a product which causes the potential of the point G to be momentarily switched to a low level.

SUMMARY OF THE INVENTION

The foregoing safety device described above, however, has a problem that the safety device fails due to damage of the relay of the safety device in cases where the temperature of the heating element rises for a short period of time due to an abnormal operation of the device. When the temperature of the thermistor reaches a temperature level equal to or higher than the operating temperature of the safety device due to the rise of the temperature of the heating element, the relay is opened. If the temperature of the heating element decreases to a level lower than the operating temperature within the operating time $\tau$ of the latch circuit in this condition, the latch circuit is not activated and the relay is closed again. During this closure condition, an arc discharge occurs at the relay contact and, immediately after that, the contact is closed. The damage to the contact is particularly significant in the case of an occurrence of the contact connection immediately after the arc discharge. Moreover, repetition of the damage may lead to contact welding. In the case of contact welding, the relay is always closed, which may cause a problem that the safety device goes down.

This problem will be solved by providing a relay configuration that does not affect characteristics even in the case of an occurrence of an arc discharge between relay contacts. More specifically, there is a method of preventing the contact welding maybe prevented by selecting a contact material unsusceptible to contact welding or by increasing an opening force of the contact. Both methods, however, cause a new problem of an increase in relay cost. Moreover, another method is to set the operating time $\tau$ of the latch circuit to a small value to activate the latch circuit within a short time during opening of the relay, so that the contact connection does not occur any more after the occurrence of the arc discharge during opening of the relay. This method, however, has a problem that the latch circuit is activated by noise generated in the image forming apparatus, thereby causing a malfunction of the safety device.

The present invention has been provided in view of the above problems. Therefore, an object of the present invention is to provide an image fixing apparatus capable of preventing a relay failure and malfunction.

Another object of the present invention is to provide an image fixing apparatus, comprising: a heater; a temperature detecting element which detects a temperature of said heater; a comparison circuit for comparing an output of said temperature detecting element with a reference value; a relay which is provided in a power supply circuit for supplying electric power from a commercial power supply to said heater; a relay drive circuit which drives said relay; and an integration circuit which is provided in a signal path from said comparison circuit to said relay drive circuit and integrates a signal input to said integration circuit, wherein an integral value of the signal input to said integration circuit reaches a reference value, by which a level of a signal input to said relay drive circuit changes and said relay is switched to an open position; and a latch circuit having an input port connected to a signal path from said integration circuit to said relay drive circuit and an output port connected to a signal path from said comparison circuit to said integration circuit, wherein said latch circuit continuously transmits a signal from said output port to said integration circuit, upon a change in a signal level of said input port so that said relay is switched to the open position, and latches said relay in the open position.

Further objects of the present invention will become apparent from the following detailed description with reference to the accompanying drawings.

DESCRIPTION OF THE EMBODIMENTS

Exemplary embodiments of the present invention will be described in detail below.

First Embodiment (1) Configuration of Image Forming Apparatus

Figure 1:
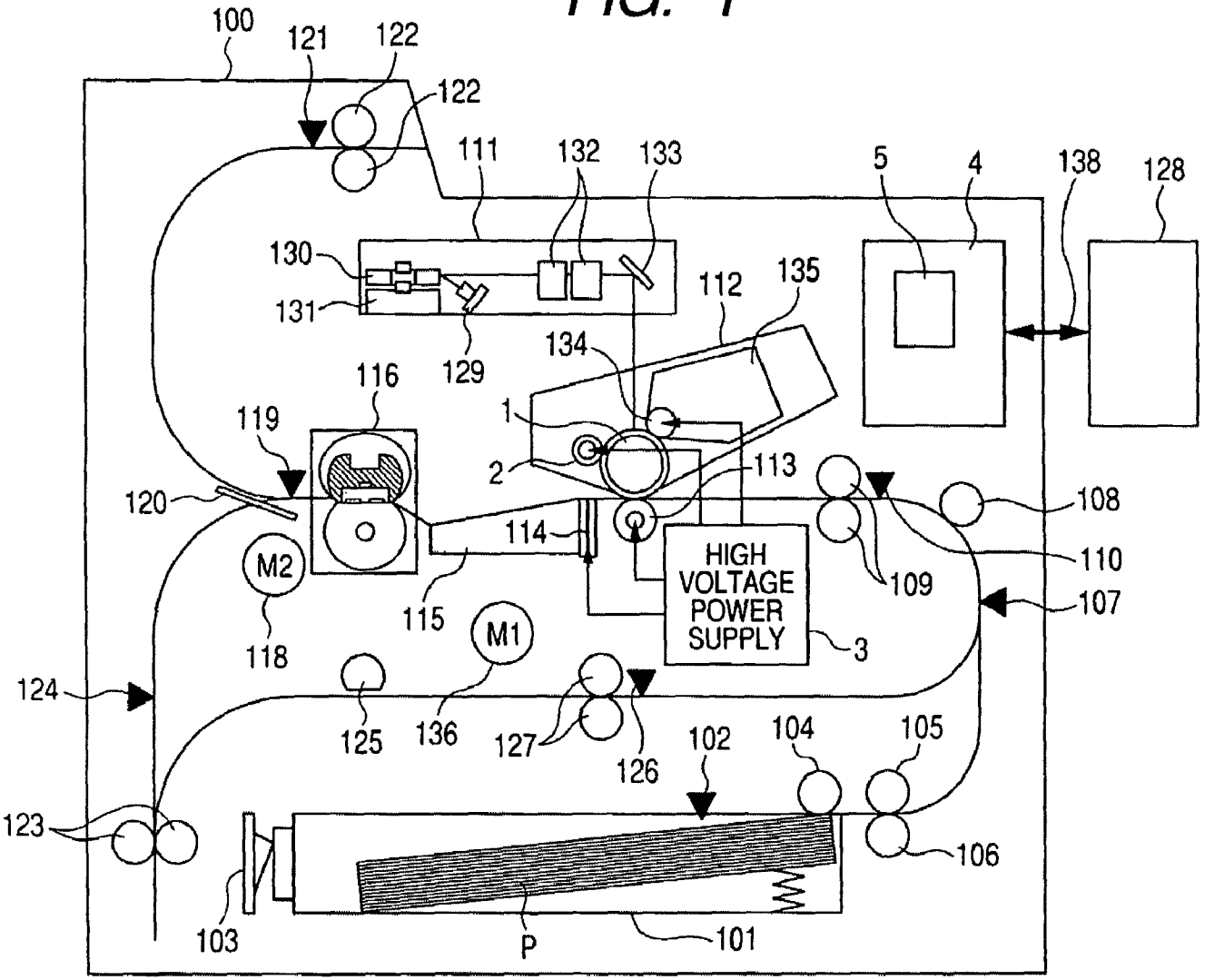
FIG. 1 is a sectional view illustrating an image forming apparatus as a first embodiment.

FIG. 1 shows a block diagram of a laser beam printer 100 having an image fixing apparatus according to this embodiment. The laser beam printer 100 includes a cassette 101 for housing recording sheets P and a paper presence/absence sensor for detecting the presence or absence of the recording sheet P in the cassette 101. Moreover, the laser beam printer 100 is provided with a paper size detection sensor 103 for detecting the size of the recording sheet P in the cassette 101, a pickup roller 104 for picking up the recording sheet P from the cassette 101, and a paper feed roller 105 for conveying the recording sheet P picked up by the pickup roller 104. Further, the laser beam printer 100 has a retard roller 106 which forms a pair with the paper feed roller 105 to prevent multi-feeding of the recording sheet P. Moreover, in the downstream of the paper feed roller 105, the laser beam printer 100 has a paper feed sensor 107 for detecting a paper feed and paper conveyance state from the cassette 101 and a double-side reversing section described later and a conveying roller 108 for conveying the recording sheet P further downstream. Moreover, the arrangement includes a registration roller pair 109 for conveying the recording sheet P in synchronization with print timing and a pre-registration sensor 110 for detecting the conveyance state of the recording sheet P to the registration roller pair 109. In the downstream Downstream of the registration roller pair 109, a process cartridge 112 is provided for forming a toner image on a photosensitive drum 1 based on a laser beam from a laser scanner 111. The laser scanner 111 includes a semiconductor laser 129 for emitting a laser beam according to image information, a polygon mirror 130 for scanning the laser beam, a motor 131 for driving the polygon mirror 130, a lens 132, and a mirror 133. The process cartridge 112 includes a charge roller 2 for electrically charging the photosensitive drum 1, a toner collecting section 135 for collecting toner, and a developing roller 134 for supplying the photosensitive drum 1 with toner, besides the photosensitive drum 1. There are further provided a roller member 113 (hereinafter, referred to as "transfer roller") for transferring the toner image formed on the photosensitive drum 1 to the recording sheet P and a discharge member 114 (hereinafter, referred to as "static charge eliminator") for eliminating the electric charges on the recording sheet P to assist the separation of the recording sheet P from the photosensitive drum 1. Still further, in the downstream of the static charge eliminator 114, there are provided a conveying guide 115 and an image fixing apparatus 116 for heat-fixing the toner image transferred onto the recording sheet P. Moreover, the arrangement includes a fixing and delivery sensor 119 for detecting the conveyance state of the recording sheet P from the image fixing apparatus 116 and a duplex flapper 120 for switching the destination of the recording sheet P conveyed from the image fixing apparatus 116 to a sheet discharge section or to the double-side reversing section. Moreover, in the downstream of the sheet discharge section side, there are arranged a paper delivery sensor 121 for detecting the paper conveyance state of the sheet discharge section and a sheet discharge roller pair 122 for delivering the recording sheet P. On the other hand, in the downstream of the double-side reversing section side, there are a reversing roller pair 123 for switching back the recording sheet P by direction reversal and a reversing sensor 124 for detecting the paper conveyance state to the reversing roller pair 123. The double-side reversing section is used to reverse the double-side of the recording sheet P after the completion of one-side printing to make printing on both sides of the recording sheet P and to feed the recording sheet P to the image forming section again. Moreover, there are provided a D-cut roller 125 for conveying the recording sheet P from a lateral registration section (not shown) for aligning the lateral position of the recording sheet P and a duplex sensor 126 for detecting the conveyance state of the recording sheet P in the double-side reversing section. Further, a duplex conveying roller 127 is provided for conveying the recording sheet P from the double-side reversing section to the paper feed section. A motor M1 136 drives the photosensitive drum 1 and a plurality of rollers 104, 105, and 108, and a motor M2 118 drives the image fixing apparatus 116. A high voltage power supply 3 applies a high voltage to the charge roller 2 and the developing roller 134. A host computer 128 is connected to the image forming apparatus 100. A controller 4 has a CPU 5 to exchange information 138 between the host computer 128 and the controller 4.

(2) Image Fixing Apparatus

Figure 2:
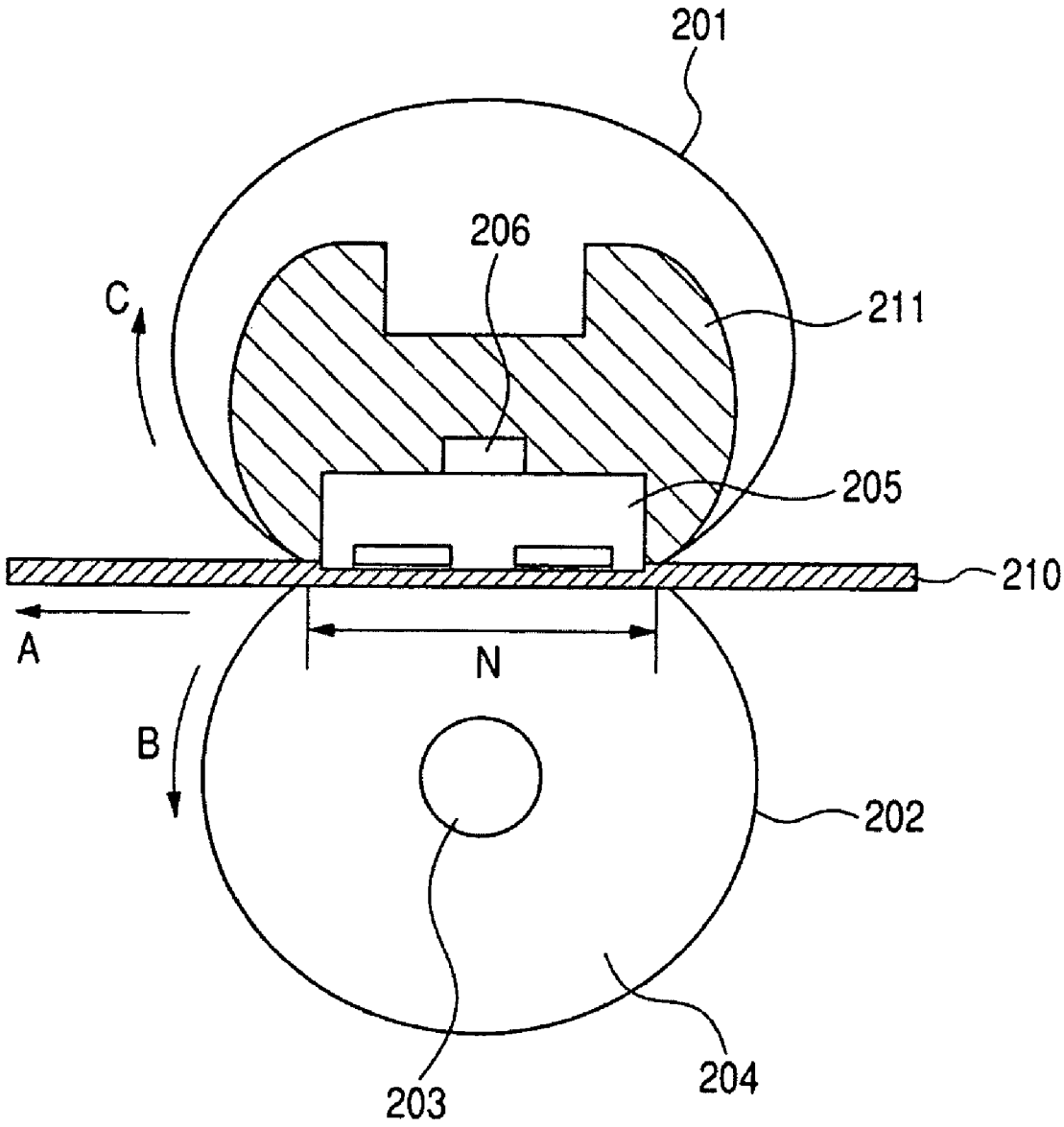
FIG. 2 is a sectional view illustrating a configuration of an image fixing apparatus in the first embodiment.

FIG. 2 shows a schematic diagram of an outline configuration of the image fixing apparatus. The image fixing apparatus of this embodiment is of a film heating type as disclosed in Japanese Patent Application Laid-open Nos. H04-44075 to H04-44083 and Japanese Patent Application Laid-Open Nos. H04-204980 to H04-204984. A heat-resistant and heat-insulating rigid stay 211 has a ceramic heater 205 and guides a film 201. The rigid stay 211 is an oblong member having a longitudinal direction which crosses perpendicularly to the conveying path (a longitudinal direction perpendicular to the plane of the drawing) of a recording sheet 210 (corresponding to the recording sheet P in FIG. 1). The ceramic heater 205 is, as described later, an oblong member having a longitudinal direction which crosses perpendicularly to the conveying path. The ceramic heater 205 is inserted into a groove formed along the longitudinal direction on the bottom surface of the stay 211 and fixedly supported by the stay 211 via heat-resistant adhesive. A heat-resistant film material 201 (hereinafter, referred to as "fixing film") is cylindrical and loosely fitted onto the stay 211 to which the ceramic heater 205 is attached. For example, the fixing film 201 is a cylindrical single-layer film of PTFE, PFA, or FEP having heat resistance, transfer efficiency, strength, and durability, which is on the order of 40 to 100 μm thick, or a composite-layer film which is formed by applying a coat of PTFE, PFA, or FEP to the outer peripheral surface of a cylindrical film of polyimide, polyamide, PEEK, PES, or PPS. A pressure roller 202 is an elastic roller made of a cored bar 203 and a heat-resistant elastic layer 204 such as silicon rubber in such a way that the roller-shaped heat-resistant elastic layer 204 is provided on the outer periphery of the cored bar 203 coaxially and integrally with each other. The pressure roller 202 is welded with pressure to the ceramic heater 205 on the stay 211 side with the fixing film 201 put therebetween against the elasticity of the pressure roller 202. The range indicated by an arrow N is a fixing nip portion formed by the pressure welding. The fixing and drive motor M2 118 (See FIG. 1) rotationally drives the pressure roller 202 at a predetermined peripheral speed in the direction indicated by an arrow B. A turning force directly acts on the fixing film 201 due to a frictional force generated between the pressure roller 202 and the outer surface of the fixing film 201 in the fixing nip portion N by the rotational drive of the pressure roller 202. When the recording sheet 210 is guided into the fixing nip portion N in the direction indicated by an arrow A, a turning force indirectly acts on the fixing film 201 via the recording sheet 210. This action causes the fixing film 201 to be rotationally driven in the clockwise direction indicated by an arrow C while the fixing film 201 is pressure-welded and slides to the bottom surface of the ceramic heater 205. The stay 211 functions also as a film inner surface guide member so as to facilitate the rotation of the fixing film 201. To reduce the sliding friction between the inner surface of the fixing film 201 and the bottom surface of the ceramic heater 205, a little lubricant such as heat-resistant grease may be interposed between the surfaces. The image fixing apparatus then enters a wait state for the steady state of the rotation of the fixing film 201 caused by the rotation of the pressure roller 202 and for a predetermined temperature rise of the ceramic heater 205. In this state, the recording sheet 210 to which the image is to be fixed is guided into the portion between the fixing film 201 and the pressure roller 202 in the fixing nip portion N formed between the ceramic heater 205 and the pressure roller 202 with the fixing film therebetween, and then the fixing nip portion N is pinched and conveyed along with the fixing film 201. Thereby, the heat of the ceramic heater 205 is applied to an unfixed image on the recording sheet 210 via the fixing film 201 and the unfixed image on the recording sheet 210 is heat-fixed to the surface of the recording sheet 210. The recording sheet 210 having passed through the fixing nip portion N is separated from the surface of the fixing film 201 and conveyed. The arrow A in FIG. 2 indicates the conveying direction of the recording sheet 210.

(3) Ceramic Heater

Figure 3:
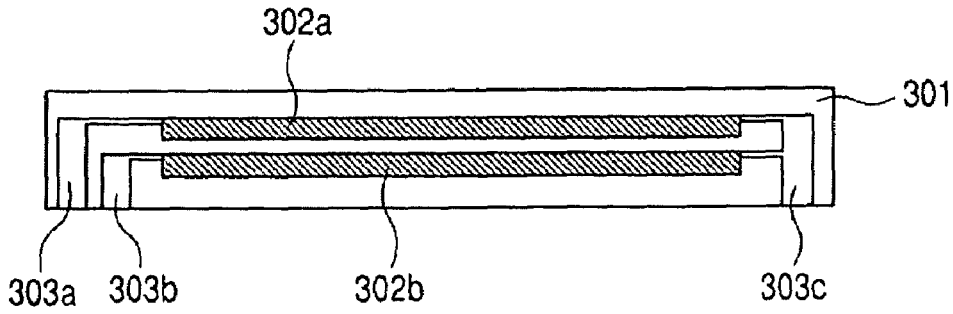
FIG. 3 is a block diagram of a ceramic heater in the first embodiment.

FIG. 3 shows a block diagram of the ceramic heater. The ceramic heater is disposed along a direction crossing perpendicularly to the conveying direction of the recording sheet. Alumina ($Al_2O_3$) is used as a base material 301 in the ceramic heater and two heat generation patterns 302*a* and 302*b* are formed by printing on one surface side. Moreover, the heat generation patterns 302*a* and 302*b* are coated with a glass protection film as an electrically insulating layer. In this embodiment, the heater section formed by the heat generation pattern 302*a* is referred to as a main heater and the heater section formed by the heat generation pattern 302*b* is referred to as a subheater. Power feeding electrodes 303*a*, 303*b*, and 303*c* are formed so as to apply a voltage to both ends of each heat generation pattern. The main heater 302*a* significantly differs from the subheater 302*b* in heat distribution.

Figure 4:
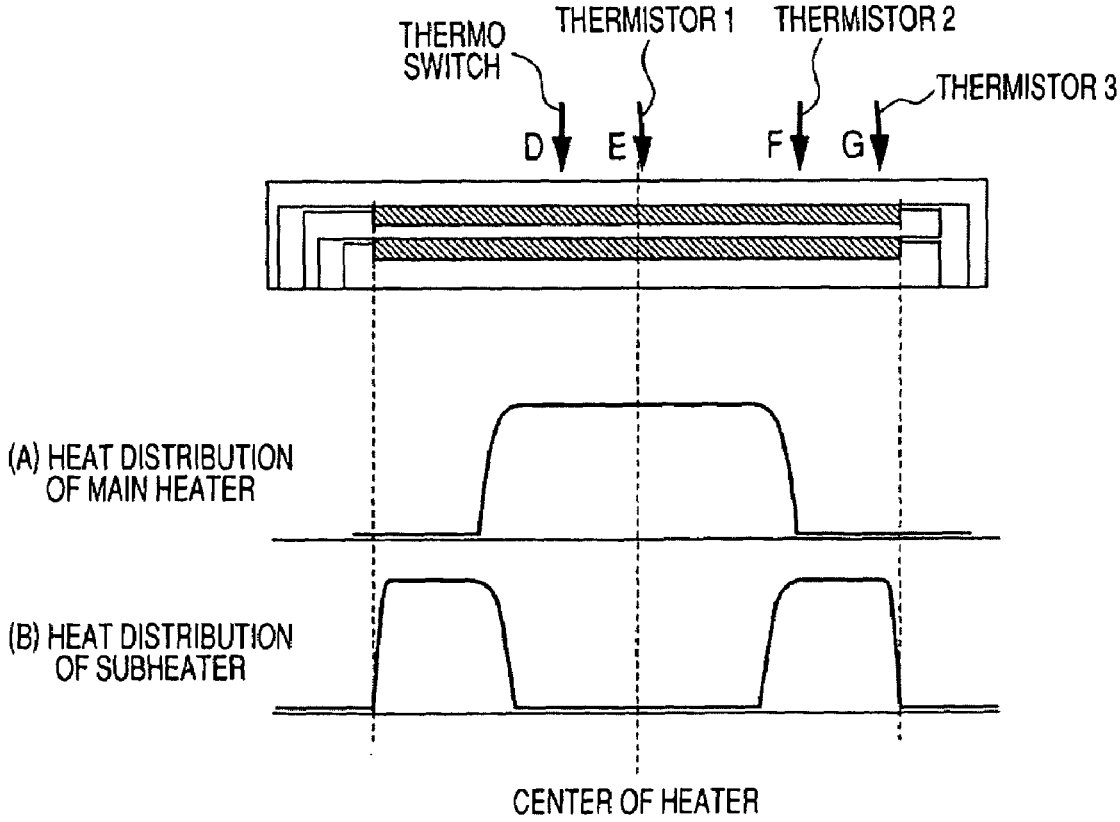
FIG. 4 is an explanatory diagram on heat distribution of the ceramic heater in the first embodiment.

FIG. 4 shows the heat distribution of the main heater 302*a* and that of the subheater 302*b*. A heating value of the main heater 302*a* is high in the center of the ceramic heater. On the other hand, a heating value of the subheater 302*b* is high at the ends of the ceramic heater.

(4) Thermistor

The image fixing apparatus of this embodiment has three thermistors for measuring temperatures of the ceramic heater. Each of the thermistors is pushed to the top surface of the ceramic heater with a predetermined pressure. FIG. 4 shows a spatial relationship between the thermistors. The positions of the thermistors in the longitudinal direction of the ceramic heater are indicated by arrows E, F, and G. The thermistor 1 is disposed in the center of the ceramic heater. On the other hand, the thermistors 2 and 3 are disposed at an end of the ceramic heater. The thermistors are connected to a temperature detection circuit which is not shown. An arrow D indicates the disposed position of the thermo switch. The thermo switch is connected to a feeder circuit from the commercial power supply 504 to the ceramic heater 205, separately from a relay 505 described later. If the temperature of the ceramic heater 205 rises to an abnormal temperature level, the thermo switch is activated to shut off the feeder circuit. The thermo switch is one of safety devices. Therefore, the image fixing apparatus of this embodiment is provided with the safety device with the thermo switch in addition to the safety device with the relay 505 described later, thus having a fail-safe feature.

Figure 6:
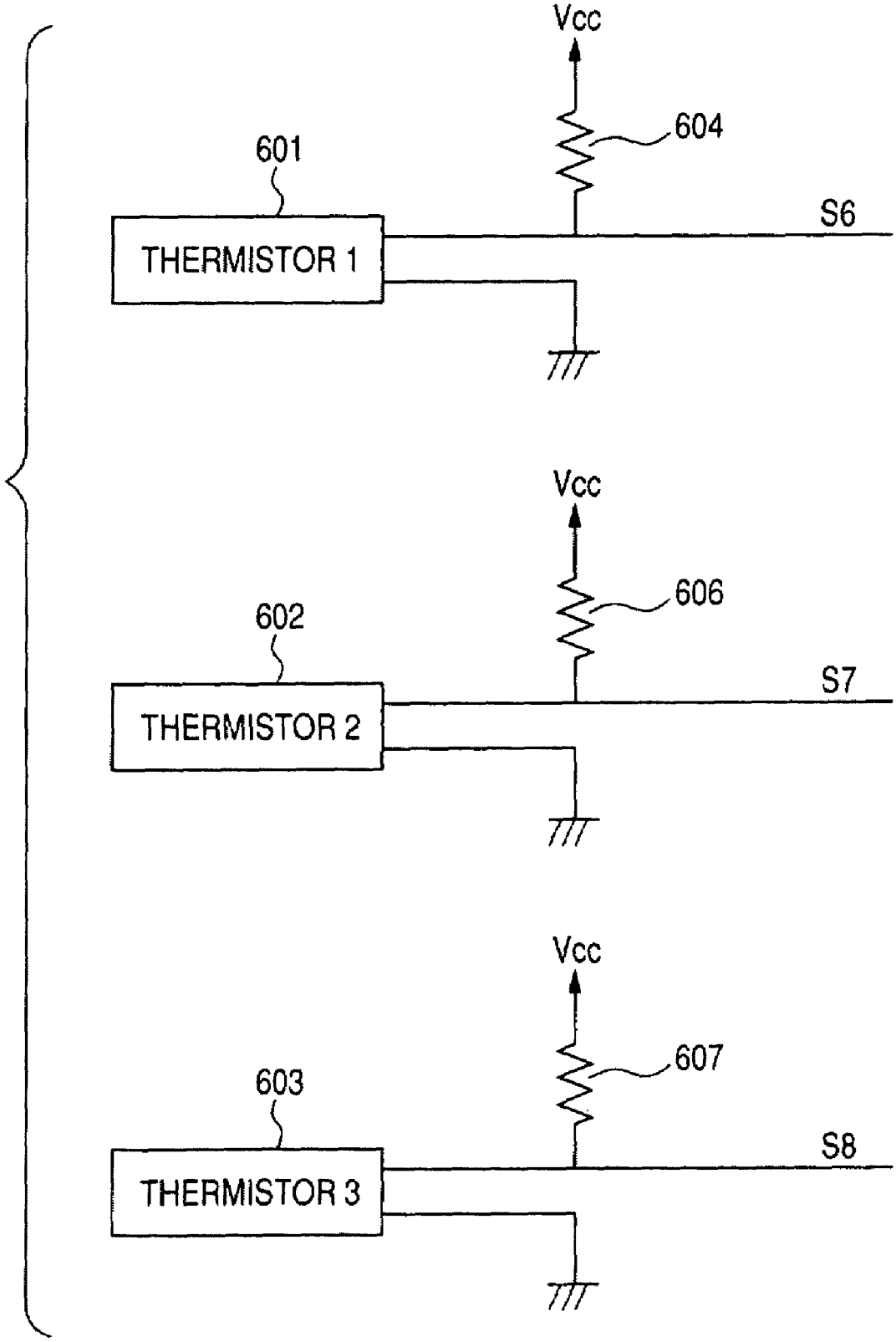
FIG. 6 is a block diagram of a temperature detection circuit in the first embodiment.

FIG. 6 shows an internal circuit of the temperature detection circuit. The thermistors 1, 2, and 3 are connected to resistors 604, 606, and 607 in series, respectively. Detection signals S6, S7, and S8 change according to the resistance values of the thermistors that vary with the temperatures. The resistance values of the thermistors decrease as the temperature increases. Therefore, the detection signals S6, S7, and S8 have a characteristic that the higher the detected temperature is, the lower the voltage level is. The detection signal S7 is connected only to a CPU 501. On the other hand, detection signals S6 and S8 are connected to the CPU 501 and to a safety device described later.

(5) Thermo Switch

The image fixing apparatus according to this embodiment has one thermo switch, which is not shown, as a current-interrupting unit in case of abnormal overheating. The thermo switch is pushed onto the ceramic heater 205 with a predetermined pressure. FIG. 4 shows the position of the thermo switch in the longitudinal direction of the ceramic heater.

The operating temperature of the thermo switch is 250° C. The operating temperature of the thermo switch will now be described. The operating temperature of the thermo switch significantly relates to the rate of temperature rise up to the operating temperature. More specifically, if the rate of temperature rise up to the operating temperature is low lower, the thermo switch is activated at a temperature correspondingly closer to the operating temperature 250° C. This characteristic is caused by a heat capacity of the thermo switch itself.

(6) Electric Power Control Circuit

Figure 5:
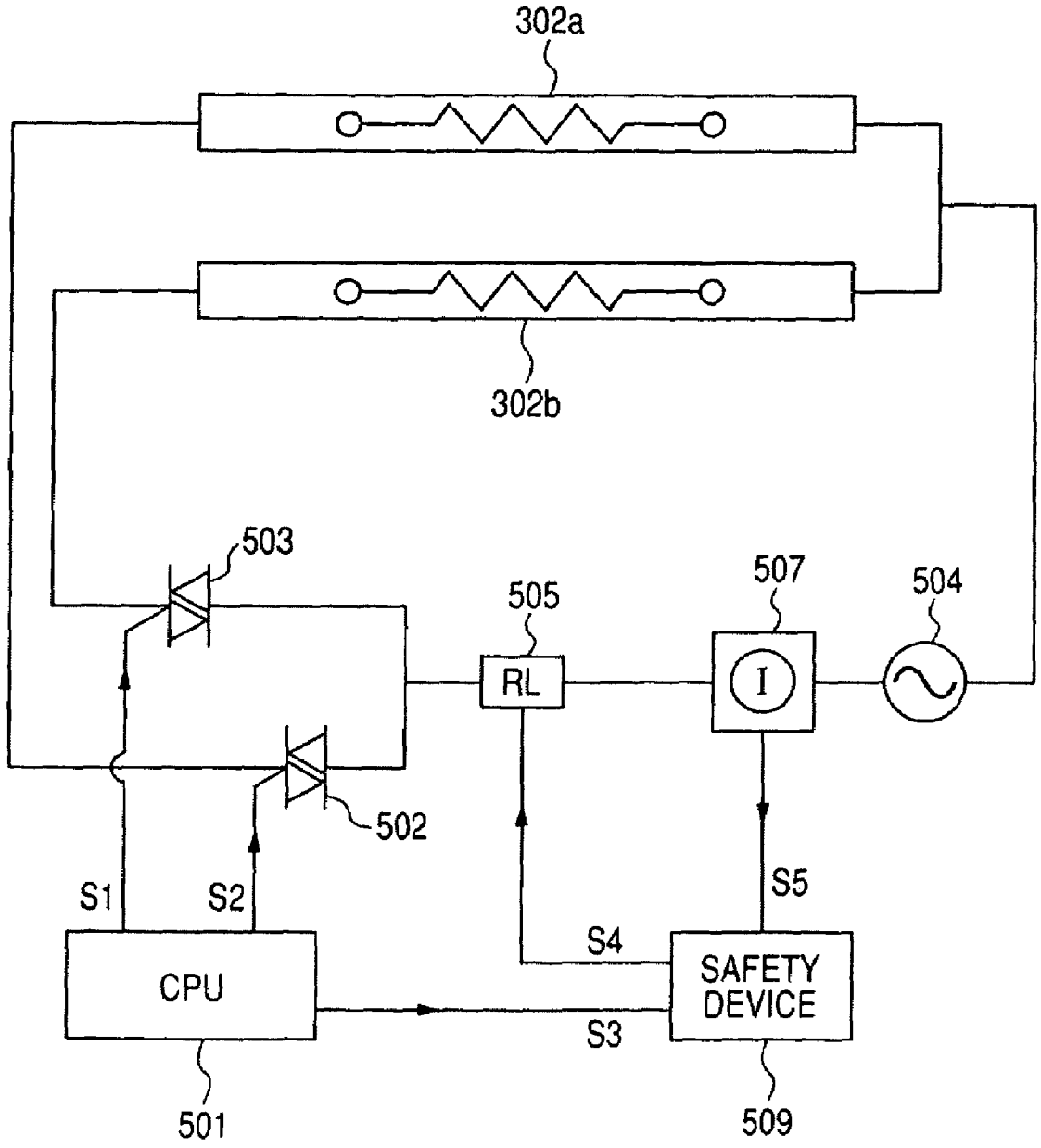
FIG. 5 is a block diagram of an electric power control circuit in the first embodiment.

The following describes an electric power control circuit that supplies electric power to the ceramic heater. The power control is performed by the main heater 302*a* and the subheater 302*b*, independently of each other. FIG. 5 shows a connection diagram of the electric power control circuit. FIG. 5 illustrates the CPU 501, first and second bidirectional triode thyristors 502 and 503, an AC power supply (commercial power supply) 504, and a relay 505. The first bidirectional triode thyristor 502 and the main heater 302*a* are connected in series, the second bidirectional triode thyristor 503 and the subheater 302*b* are connected in series, and they are connected in parallel to the AC power supply 504. The first bidirectional triode thyristor 502 and the second bidirectional triode thyristor 503 are on-off controlled by an on-off operation of first and second heater drive signals S1 and S2 from the CPU 501.

The on-off control of the first and second bidirectional triode thyristors 502 and 503 using the first and second heater drive signals S1 and S2 based on the detection outputs of the thermistors enables the control of the ceramic heater 205 to a desired temperature. In this embodiment, the ceramic heater 205 is controlled so as to achieve a detected value of 200° C. in the thermistor 1.

The relay 505 is interposed between the first and second bidirectional triode thyristors 502 and 503 and the AC power supply 504 (power supply circuit) to form a configuration enabling the relay 505 to be driven to shut off the electricity to the main heater 302*a* and the subheater 302*b*. The control signal for the relay 505 is supplied from a safety device 509 described later.

(7) Safety Device

The image fixing apparatus according to this embodiment is provided with a safety device to prevent overheating of the ceramic heater 205 which may be caused by current runaway. The image fixing apparatus has a circuit, serving as a safety device, which detects abnormal overheating of the ceramic heater 205 by using the thermistor 1 and shuts off electricity at the time of abnormal overheating, in addition to the foregoing thermo switch.

A temperature of 220° C. is used to determine the abnormal overheating in the thermistor 1. As described above, in the image fixing apparatus of this embodiment, the ceramic heater 205 is controlled so as to achieve a detected value of 200° C. in the thermistor 1. Therefore, the safety device is not activated during normal operation. In the case of current runaway, the safety device is activated at the detected temperature of 220° C. to shut off the electricity to the ceramic heater 205.

Figure 8:
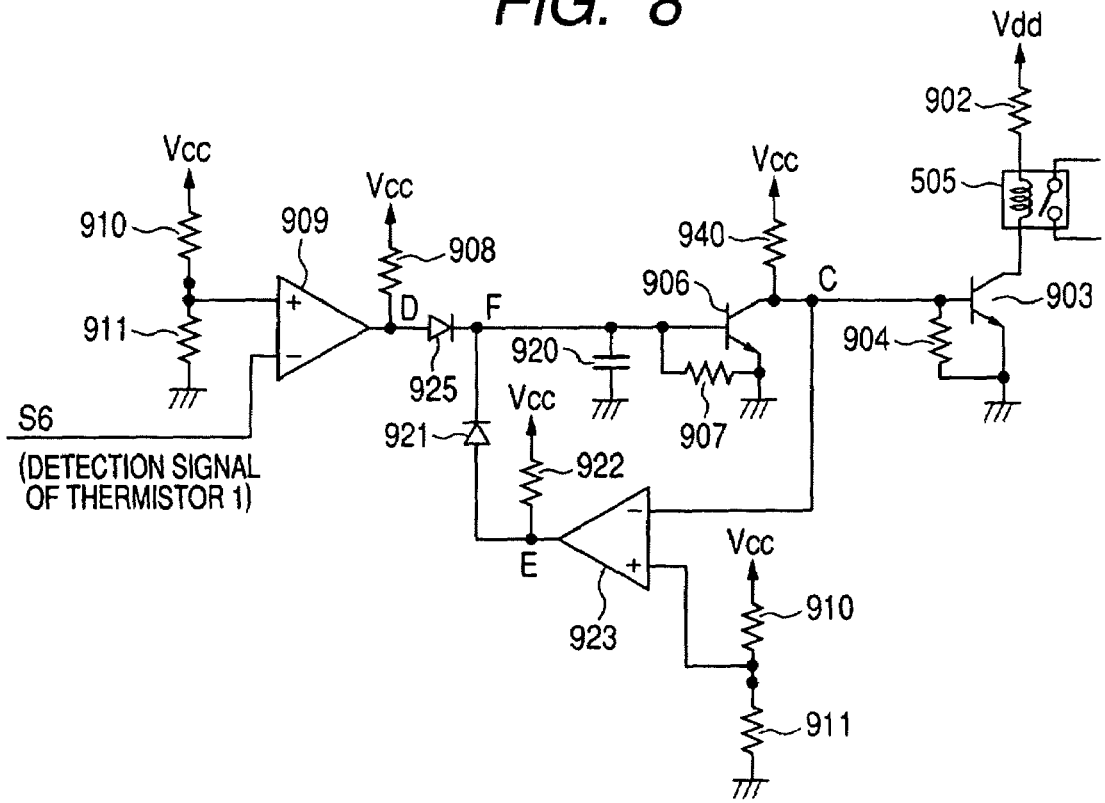
FIG. 8 is a circuit diagram of the safety device in the first embodiment.

The following describes the details of the configuration of the safety device with reference to FIG. 8. The detection signal S6 of the thermistor 1 is input to the negative input of a comparator 909 to be compared with a reference voltage Vref input to the positive terminal. The detection signal of the thermistor 1 is compared with a value obtained by dividing the reference voltage Vref, namely the supply voltage Vcc between resistors 910 and 911. The safety device operates according to the level of the thermistor 1 as described below.

Figure 7:
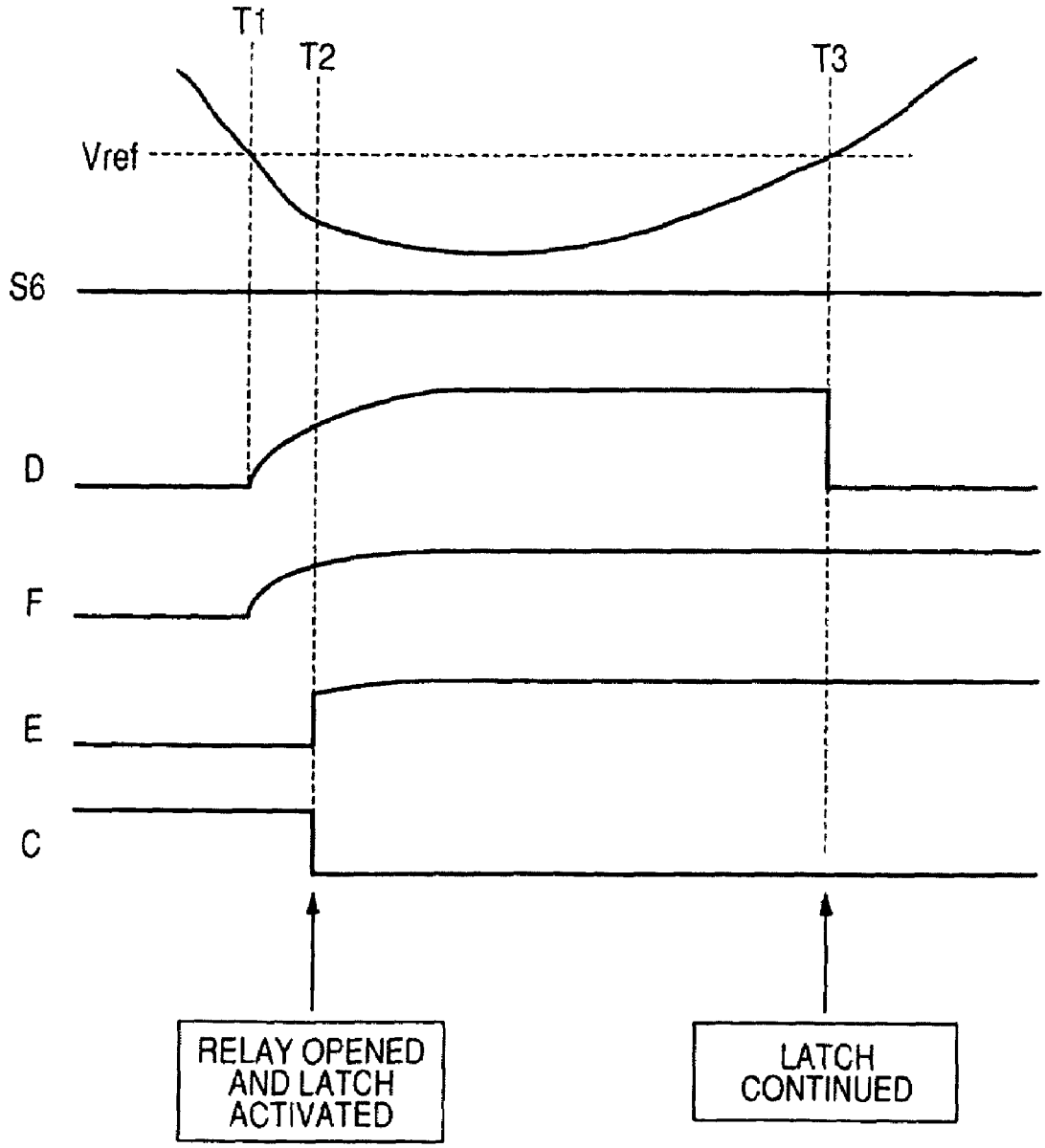
FIG. 7 is a waveform diagram illustrating the waveforms at internal nodes of a safety device in the first embodiment.

(1) If the temperature of the thermistor 1 is equal to or higher than the abnormal overheating temperature FIG. 7 shows waveforms at the respective portions of the safety device in the overheating condition of the ceramic heater 205 caused by current runaway. If the detection signal S6 level of the thermistor 1 (temperature detecting element) decreases due to a temperature rise to a level equal to or lower than the reference voltage (reference value) Vref, the output D of the comparator (comparison circuit) 909 switches from low to high (timing T1). Upon the switching of the output D of the comparator 909 to high, current starts to flow from the power supply Vcc to a capacitor 920 and a resistor 907 via a resistor 908 and a diode (first diode) 925. An integration circuit including the capacitor 920 and the resistor 907 gradually increases a base voltage of a transistor 906. The integration circuit is provided in a signal path from the comparator 909 to a relay drive circuit for driving the relay 505. When the base voltage of the transistor 906 reaches the on-state voltage (reference value) of the transistor 906, the transistor 906 is switched on (timing T2). Then Thereby, the potential of point C is switched to a low level, a transistor 903 is switched off, and the relay 505 is opened to stop the electricity to the ceramic heater 205. Thus, the timing T2 is a relay opening timing. The signal level to the transistor 903 in the relay drive circuit does not change until the integral value of the signal input to the integration circuit reaches the reference value (the on-state voltage of the transistor 906), thereby preventing malfunction of the relay which is caused by noise.

Subsequently, a latch operation will be described. The point C is an input port of a latch circuit having an operational amplifier 923 and point F is an output port of the latch circuit. The point C which is an input port is connected to a signal path from the integration circuit to the relay drive circuit and the point F which is an output port is connected to a signal path from the comparison circuit to the integration circuit. A signal from the point C is input to the negative input of the operational amplifier 923 and compared with a reference voltage which is input to the positive input. The reference voltage is generated by dividing the supply voltage Vcc between the resistors 910 and 911. As described above, if the detection signal S6 level of the thermistor 1 decreases due to a temperature rise and the potential of the point C switches from high to low, the output (point E) of the operational amplifier 923 switches from low to high. Thereby, a diode (second diode) 921 is energized and current flows into the base of the transistor 906 via a resistor 922 and the diode 921 in addition to the current flowing through the base via the resistor 908 and the diode 925.

If the detection signal S6 level of the thermistor 1 increases (specifically, if the relay 505 is opened to shut off the power supply to the heater and thereby the temperature of the heater decreases) and the output voltage (point D) of the comparator 909 switches from high to low (timing T3), the diode 925 is switched off. The diode 921, however, is continuously in the on-state and current continues to flow into the base of the transistor 906 from the power supply Vcc via the resistor 922 and the diode 921, and therefore the transistor 906 is on. In other words, the de-energized state of the ceramic heater 205 is latched. The latch of the de-energized state is maintained unless the power supply Vcc is turned off. As shown in FIG. 7, the relay 505 is opened and the latch is activated at the timing T2. At the timing T3, the potential of the point C maintains the low level since the output E of the operational amplifier 923 maintains the high level though the output (point D) of the comparator 909 switches from high to low, and the relay 505 is latched in the open position. In this manner, if the signal level at the point C which is an input port changes so as to open the relay 505, the latch circuit continues to transmit a signal to the integration circuit from the point F which is an output port to latch the relay 505 in the open position. Therefore, once the relay 505 is opened, the relay 505 is maintained in the open position even after the temperature of the heater decreases, thus preventing the relay 505 from repeating open and close operations.

(2) If the temperature of the thermistor 1 is lower than the abnormal overheating temperature Since the output signal S6 level of the thermistor 1 is higher than the reference voltage Vref, the output of the comparator 909 becomes low. Thereby, current, which flows from the power supply Vcc via the resistor 908, flows into the output terminal of the comparator 909, but current does not flow into the base of the transistor 906. Specifically, the transistor 906 is switched off and the potential of the point C becomes high. Thereby, current flows into the base of the transistor 903 via a resistor 940 from the power supply Vcc and the transistor 903 is switched on. Upon the switch-on of the transistor 903, a power supply Vdd applies current to the relay 505, by which the relay 505 is closed (a state which enables electric power to be supplied to the heater).

If the line of the point C momentarily changes from high to low due to noise, the output of the operational amplifier 923 changes from low to high in a short time period. The capacitor 920 and the resistor 907, however, inhibit the increase in the base voltage of the transistor 906 and therefore the transistor 906 is not switched on. In other words, the relay 505 maintains the closed position so as to prevent malfunction of the safety device which may be caused by noise.

As described above, the image fixing apparatus according to this embodiment is capable of preventing relay failure and malfunction.

Second Embodiment

The second embodiment is the same as the first embodiment in a basic structure, though different in that the image fixing apparatus of the second embodiment includes a plurality of sets of a temperature detecting unit, a temperature comparing unit, and a latch unit.

Figure 9:
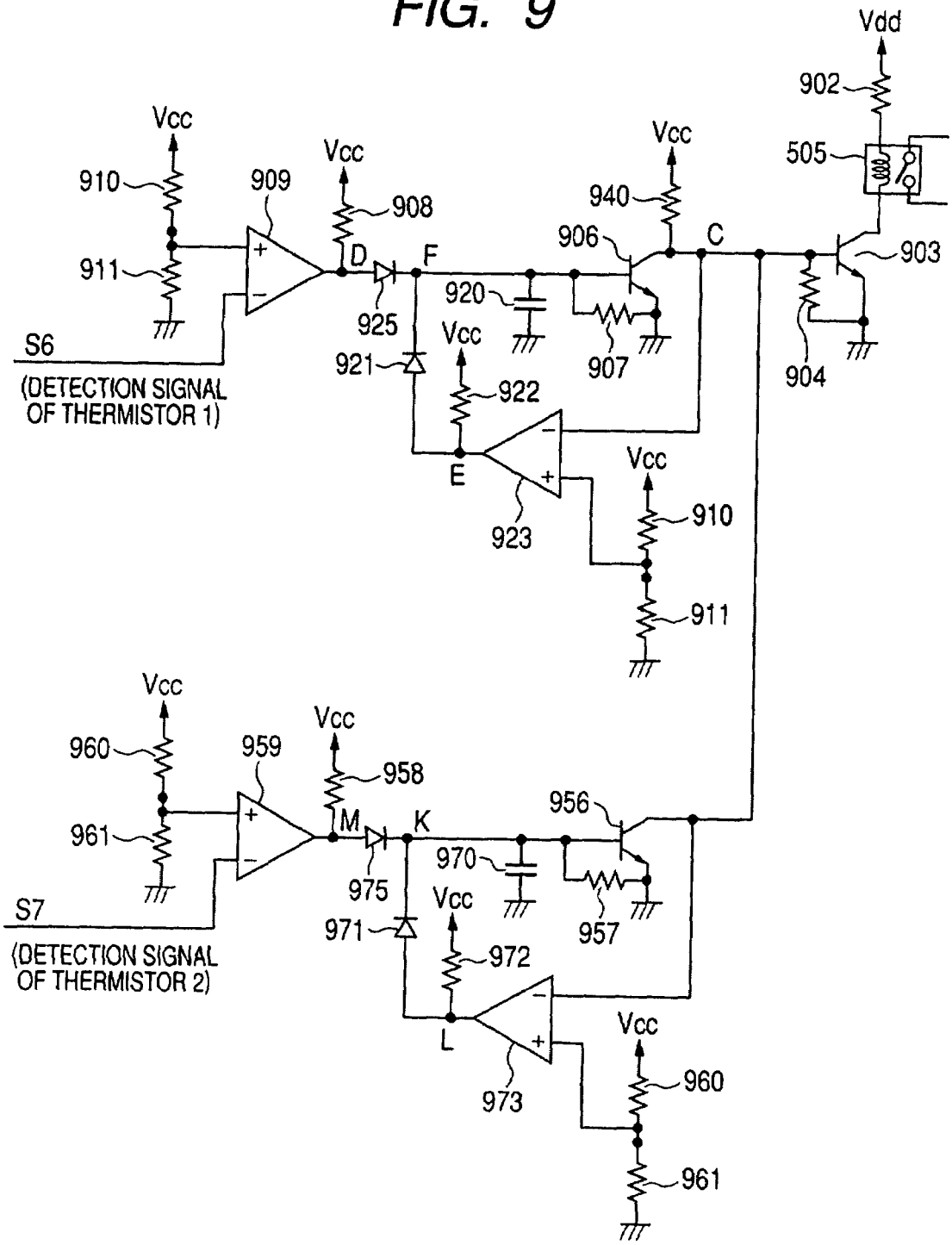
FIG. 9 is a circuit diagram of a safety device in a second embodiment.
Figure 10:
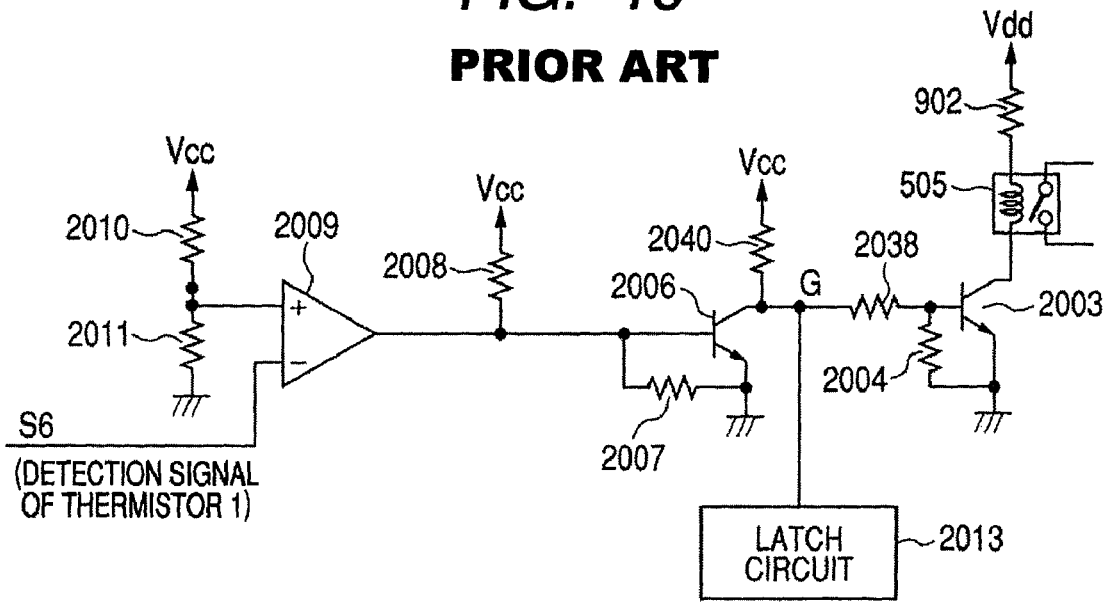
FIG. 10 PRIOR ART
FIG. 10 is a circuit diagram of a conventional safety device.

FIG. 9 shows a block diagram of a safety device according to this embodiment. The circuit for opening the relay 505 according to the detection signal S6 of the thermistor 1 is the same as in the first embodiment. The image fixing apparatus, however, further includes a circuit for opening the relay based on the detection signal S7 of the thermistor 2 (a second temperature detecting element).

If the detection signal S7 level of the thermistor 2 decreases due to a temperature rise and becomes less than the reference voltage Vref, the output of a comparator (a second comparison circuit) 959 switches from low to high. When the output of the comparator 959 switches to high, current starts to flow from the power supply Vcc to a capacitor 970 and a resistor 957 via a resistor 958. A second integration circuit including a capacitor 970 and a resistor 957 gradually increases a base voltage of a transistor 956. When the base voltage of the transistor 956 reaches an on-state voltage of the transistor 956, the transistor 956 is switched on. Thereafter, the transistor 903 is switched off and the potential of the point C is switched to a low level, by which the electricity to the ceramic heater 205 is stopped. Moreover, the switching of the point C from high to low causes switching of an output (point L) of an operational amplifier 973 in a second latch circuit from low to high. Thereby, a diode 972 is energized and the de-energized state of the ceramic heater 205 is latched.

As described hereinabove, the image fixing apparatus according to this embodiment includes a plurality of sets of the temperature detecting unit, the temperature comparing unit, and the integration unit in the first embodiment. Thereby, the same effect as the first embodiment is obtained in cases where one of the plurality of temperature detecting units detects an abnormally high temperature.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-099508, filed Apr. 7, 2008, which is hereby incorporated by reference in its entirety.

What is claimed is:

1. An image fixing apparatus comprising:
- a heater;
- a temperature detecting element which detects a temperature of said heater;
- a comparison circuit which compares an output of said temperature detecting element with a reference value;
- a relay which is provided in a power supply circuit for supplying electric power from a commercial power supply to said heater;
- a relay drive circuit which drives said relay; and
- an integration circuit which is provided in a signal path from said comparison circuit to said relay drive circuit and integrates a signal input to said integration circuit, wherein an integral value of the signal input to said integration circuit reaches a reference value, by which a level of a signal input to said relay drive circuit changes and said relay is switched to an open position; and
- a latch circuit having an input port connected to a signal path from said integration circuit to said relay drive circuit and an output port connected to a signal path from said comparison circuit to said integration circuit, wherein said latch circuit continuously transmits a signal from said output port to said integration circuit, upon a change in a signal level of said input port so that said relay is switched to the open position, and latches said relay in the open position.

2. The image fixing apparatus according to claim 1, wherein a first diode is provided between an intersection point, which is formed by an intersection of the signal path from said comparison circuit to said integration circuit and the output port of said latch circuit, and said comparison circuit so that an anode is on the side of said comparison circuit and a cathode is on the side of said intersection point, and a second diode is provided between said intersection point and said latch circuit so that an anode is on the side of said latch circuit and a cathode is on the side of said intersection point.

3. The image fixing apparatus according to claim 1, wherein said apparatus further comprises:
- a second temperature detecting element which detects a temperature of said heater;

a second comparison circuit which compares an output of said second temperature detecting element with a reference value;

a second integration circuit which is provided in a signal path from said second comparison circuit to said relay drive circuit and integrates a signal input to said second integration circuit; and a second latch circuit having an input port connected to a signal path from said second integration circuit to said relay drive circuit and an output port connected to a signal path from said second comparison circuit to said second integration circuit, wherein, in cases where an integral value of the signal input to one of said two integration circuits reaches a reference value, said relay is switched to an open position and latched in the open position.

4. The image fixing apparatus according to claim 1, further comprising:

a cylindrical fixing film whose internal surface is in contact with said heater; and a pressure roller which forms a fixing nip portion along with said heater via said fixing film.

* * * * *